United States Patent [19]

Biswas et al.

[11] Patent Number: 5,069,776

[45] **Date of Patent: * Dec. 3, 1991**

[54] PROCESS FOR THE CONVERSION OF A HYDROCARBONACEOUS FEEDSTOCK

[75] Inventors: Jaydeep Biswas; Ian E. Maxwell; Johan M. Van Der Eijk, all of Amsterdam, Netherlands

[73] Assignee: Shell Oil Company, Houston, Tex.

[ * ] Notice: The portion of the term of this patent subsequent to Dec. 12, 2006 has been disclaimed.

[21] Appl. No.: 482,613

[22] Filed: Feb. 21, 1990

[30] Foreign Application Priority Data

Feb. 27, 1989 [GB] United Kingdom ..... 8904409

[51] Int. Cl.[5] ..... C10G 11/18

[52] U.S. Cl. ..... 208/120; 585/653

[58] Field of Search ..... 208/120

[56] References Cited

U.S. PATENT DOCUMENTS

| | | | |
|---|---|---|---|
| 3,926,778 | 12/1975 | Owen et al. | 208/120 |
| 3,928,175 | 12/1975 | Owen et al. | 208/93 |
| 4,035,285 | 7/1977 | Owen et al. | 208/120 |
| 4,090,949 | 5/1978 | Owen et al. | 208/78 |
| 4,100,218 | 7/1978 | Myers, Jr. et al. | 260/666 PY |
| 4,390,413 | 6/1983 | O'Rear et al. | 208/61 |
| 4,502,945 | 3/1985 | Olbrich et al. | 208/120 |
| 4,886,934 | 12/1989 | Maxwell et al. | 585/660 |

*Primary Examiner*—Anthony McFarlane

[57] ABSTRACT

Process for the conversion of a hydrocarbonaceous feedstock having an end boiling point of at most 330° C., which process comprises contacting the feedstock with a moving bed of a zeolitic catalyst comprising a zeolite with a pore diameter of 0.3 to 0.7 nm at a temperature above 500° C. during less than 10 seconds.

9 Claims, No Drawings

PROCESS FOR THE CONVERSION OF A HYDROCARBONACEOUS FEEDSTOCK

BACKGROUND OF THE INVENTION

1. Field of the Invention

The present invention relates to a process for the conversion of a hydrocarbonaceous feedstock.

2. Related Application

This application is related to application Ser. No. 07/482599, filed 2/21/90, now abandoned.

3. Description of the Related Art:

In U.S. Pat. No. 4,390,413 (issued June 28, 1983) a process is described in which a hydrocarbonaceous feedstock is upgraded by contacting the feedstock with a ZSM-5 containing catalyst in a fixed bed reactor at a pressure below 14 bar, a temperature of 260 to 427° C. and a space velocity of 0.1 to 15 1/1.h. The feedstock must contain less than 5 ppmw of nitrogen-containing compounds, calculated as nitrogen. Although the feedstock exemplified is a gas oil, suitable feedstocks include hydrocarbons with a boiling range from 82 to 649° C. The products include olefinic hydrocarbons, such as propene and butenes. This production of olefins is desirable, since they tend to be valuable products. The known process has as drawback that the feedstock must have been severely denitrified. This is necessary as the more nitrogenous feedstocks would deactivate the catalyst rapidly.

In contrast to the Related Art described above, it is a benefit of this invention that by use of certain zeolite catalysts under certain conditions an olefin-rich product can be obtained from a hydrocarbonaceous feedstock, without severe denitrification of the feedstock.

SUMMARY OF THE INVENTION

The present invention provides a process for the conversion of a hydrocarbonaceous feedstock having an end boiling point of at most 330° C., which process comprises contacting the feedstock with a moving bed of a zeolitic catalyst comprising a zeolite with a pore diameter of 0.3 to 0.7 nm, preferably 0.5 to 0.7 nm, at a temperature above 500° C. during less than 10 seconds.

DESCRIPTION OF THE INVENTION

The feedstock is contacted with the zeolitic catalyst for less than 10 seconds. Suitably, the minimum contact time is 0.1 second. Very good results are obtainable with a process in which the feedstock is contacted with the zeolitic catalyst during 0.2 to 6 seconds.

The surprising nature of the present invention is further illustrated by U.S. Pat. No. 4,100,218 (issued July 11, 1978) which describes a process for the preparation of LPG (saturate $C_{3-4}$-hydrocarbons) and gasoline starting from an olefinic stream, using a catalyst with a pore diameter of less than 0.7 nm. Since it was known that such zeolitic catalysts have activity to catalyze the conversion of olefins to saturated and aromatic hydrocarbons, it is surprising that in the present process olefins are produced and relatively little saturated gaseous hydrocarbons are formed.

The temperature during the reaction is between 500° C. and 900° C. The temperature is preferably from 550 to 800° C.

The zeolitic catalyst may comprise one or more zeolites with a pore diameter of from 0.3 to 0.7 nm. The catalyst suitably further comprises a refractory oxide that serves as binder material. Suitable refractory oxides include alumina, silica, silica-alumina, magnesia, titania, zirconia and mixtures thereof. Alumina is especially preferred. The weight ratio of refractory oxide and zeolite suitably ranges from 10:90 to 90:10, preferably from 50:50 to 85:15. The zeolitic catalyst preferably comprises as zeolite substantially only zeolites with a pore diameter of from 0.3 to 0.7 nm.

The term zeolite in this specification is not to be regarded to comprise only crystalline aluminum silicates. The term also includes crystalline silica (silicalite), silicoaluminophosphates (SAPO), chromosilicates, gallium silicates, iron silicates, aluminum phosphates (ALPO), titanium aluminosilicates (TASO), boron silicates, titanium aluminophosphates (TAPO) and iron aluminosilicates. Examples of zeolites that may be used in the process of the invention and that have a pore diameter of 0.3 to 0.7 nm, include SAPO-4 and SAPO-11, which are described in U.S. Pat. No. 4,440,871 (filed Apr. 3, 1974), ALPO-11, described in U.S. Pat. No. 4,310,440 (filed Jan. 12, 1982), TAPO-11, described in U.S. Pat. No. 4,500,651 (filed Feb. 19, 1985), TASO-45, described in EP-A-229,295, boron silicates, described in, e.g. U.S. Pat. No. 4,254,297 (filed Mar. 3, 1981), aluminum silicates like erionite, ferrierite, theta and the ZSM-type zeolites such as ZSM-5, ZSM-11, ZSM-12, ZSM-35, ZSM-23, and ZSM-38. Preferably the zeolite is selected from the group consisting of crystalline metal silicates having a ZSM-5 structure, ferrierite, erionite and mixtures thereof. Suitable examples of crystalline metal silicates with ZSM-5 structure are aluminum, gallium, iron, scandium, rhodium and/or chromium silicates as described in, e.g., GB-B-2,110,559.

After the preparation of the zeolites usually an amount of alkali metal oxide is present in the readily prepared zeolite. Preferably the amount of alkali metal is removed by methods known in the art, such as ion exchange, optionally followed by calcination, to yield the zeolite in its hydrogen form. Preferably, the zeolite used in the present process is substantially in its hydrogen form.

The pressure in the present process can be varied within wide ranges. It is, however, preferred that the pressure is such that at the prevailing temperature the feedstock is substantially in its gaseous phase or brought thereinto by contact with the catalyst. Then it is easier to achieve the short contact times envisaged. Hence, the pressure is preferably relatively low. This can be advantageous since no expensive compressors and high-pressure vessels and other equipment is necessary. A suitable pressure range is from 1 to 10 bar. Subatmospheric pressures are possible, but not preferred. It can be economically advantageous to operate at atmospheric pressure. Other gaseous materials may be present during the conversion such as steam and/or nitrogen.

The present process is preferably carried out in a moving bed. The bed of catalyst may move upwards or downwards. When the bed moves upwards a process somewhat similar to a fluidized catalytic cracking process is obtained.

During the process some coke may be formed on the catalyst. Therefore, it would be advantageous to regenerate the catalyst. Preferably the catalyst is regenerated by subjecting it after having been contacted with the feedstock to a treatment with an oxidizing gas, such as air. A continuous regeneration, similar to the regeneration carried out in a fluidized catalytic cracking process, is especially preferred.

If the coke formation does not occur at too high a rate, it would be possible to arrange for a process in which the residence time of the catalyst particles in a reaction zone is longer than the residence time of the feedstock in the reaction zone. Of course, as discussed above, the contact time between feedstock and catalyst should be less than 10 seconds. The contact time generally corresponds with the residence time of the feedstock. Suitably the residence time of the catalyst is from 1 to 20 times the residence time of the feedstock.

While the catalyst/feedstock weight ratio is not critical, it is preferred that the weight ratio varies from 1 to 150 kg or more of catalyst per kg of feedstock. Preferably, the catalyst/feedstock weight ratio is from 20 to 100:1.

The feedstock which is to be converted in the present process comprises hydrocarbons which have an end boiling point of at most 330° C. By this feature relatively light petroleum fractions, like naphtha and kerosene, are included. Preferably the feedstock has a 50% boiling point between 50 and 200° C. and an initial boiling point of −45° C. Suitable feedstocks include $C_{3-4}$-hydrocarbons (e.g., LPG), naphtha, gasoline fractions, kerosene fractions and mixtures thereof.

One of the advantages of the present invention over the process according to U.S. Pat. No. 4,390,413 (issued June 28, 1983) resides in the fact that a feedstock with a relatively high nitrogen content may be used with substantially no effect on the catalyst activity. Suitable feedstocks may have a nitrogen content of more than 25 ppmw, calculated as nitrogen. The feedstock may even have a nitrogen content of 100 to 1000 ppmw, calculated as nitrogen.

The ranges and limitations provided in the instant specification and claims are those which are believed to particularly point out and distinctly claim the instant invention. It is, however, understood that other ranges and limitations that perform substantially the same function in substantially the same way to obtain substantially the same result are intended to be within the scope of the instant invention as defined by the instant specification and claims.

EXAMPLE

The invention will be described by the following example which is provided for illustrative purposes and is not to be construed as limiting the invention.

In a series of experiments a conversion process was carried out using as feedstock a $C_{5-10}$ hydrocarbon mixture with the following distribution (as % w on feed):

| | |
|---|---|
| paraffins | 55.9 |
| naphthenes | 32.9 |
| aromatics | 11.3 |
| IBP | 50° C. |
| FBP | 199° C. |
| 50% | 119° C. |

The experiments were carried out in a down flow reactor in which co-currently a flow of feedstock and catalyst particles, having an average particle size of 74 micrometers, was passed downwards. The catalyst used comprised ZSM-5 in hydrogen form in an alumina matrix (weight ratio ZSM-5/alumina was 1:3). All experiments were carried out at atmospheric pressure. Further process conditions and the results of the experiments are indicated in the sole table below.

In the table the sign "=" indicates olefinic unsaturation.

TABLE

| | |
|---|---|
| PROCESS CONDITIONS: | |
| Reactor temperature, °C. | 580 |
| Catalyst/oil ratio, g/g | 112 |
| Contact time, s | 1.9 |
| Product, % w on feed | |
| $C_1$ | 1.4 |
| $C_2$ | 1.7 |
| $C_2$= | 7.4 |
| $C_3$ | 4.0 |
| $C_3$= | 16.5 |
| $C_4$ | 2.3 |
| $C_4$= | 8.0 |
| $C_5$-221° C. | 50.5 |
| 221-370° C. | 0.8 |
| Coke | 7.0 |

What is claimed is:

1. A process for the conversion of a hydrocarbonaceous feedstock having an end boiling point of at most 330° C, which process comprises contacting the feedstock with a moving bed of a zeolitic catalyst essentially consisting of a binder material and a zeolite which zeolite has a pore diameter of 0.3 to 0.7 nm at a temperature from 500° C. to 900° C. during less than 10 seconds and at a catalyst/feedstock weight ratio of 20 to 150:1, wherein a product is formed which is enriched in olefins.

2. The process according to claim 1, in which the feedstock is contacted with the zeolitic catalyst during 0.2 to 6 seconds.

3. The process according to claim 3, in which the temperature is from 550 to 800° C.

4. The process according to claims 1 or 2 wherein the zeolite has a pore diameter of 0.5 to 0.7 nm.

5. The process according to claim 1 in which the zeolite is selected from the group consisting of crystalline metal silicates having a ZSM-5 structure, ferrierite, erionite and mixtures thereof.

6. The process according to claims 1 or 7, in which the zeolite is substantially in its hydrogen form.

7. The process according to claims 1 or 2, in which the pressure is from 1 to 10 bar.

8. The process according to claims 1 or 2, in which the feedstock has an initial boiling point of at least −45° C.

9. The process according to claim 8, in which the feedstock is selected from the group consisting of $C_{3-4}$-hydrocarbons, naphtha, gasoline, kerosine and mixtures thereof.

* * * * *